US008479698B2

(12) United States Patent
Wanner et al.

(10) Patent No.: US 8,479,698 B2
(45) Date of Patent: Jul. 9, 2013

(54) PARALLEL STARTER SYSTEM

(75) Inventors: Hartmut Wanner, Herrenberg-Oberjesingen (DE); Thomas Majer, Barcelona (ES)

(73) Assignee: Robert Bosch GmbH, Stuttgart (DE)

( * ) Notice: Subject to any disclaimer, the term of this patent is extended or adjusted under 35 U.S.C. 154(b) by 416 days.

(21) Appl. No.: 12/735,246

(22) PCT Filed: Dec. 17, 2008

(86) PCT No.: PCT/EP2008/067753

§ 371 (c)(1),
(2), (4) Date: Nov. 17, 2010

(87) PCT Pub. No.: WO2009/089979

PCT Pub. Date: Jul. 23, 2009

(65) Prior Publication Data

US 2011/0048357 A1 Mar. 3, 2011

(30) Foreign Application Priority Data

Jan. 15, 2008 (DE) ..... 10 2008 004 381

(51) Int. Cl.
*F02N 11/08* (2006.01)

(52) U.S. Cl.
USPC ..... 123/179.3; 123/179.25; 123/179.28

(58) Field of Classification Search
USPC ..... 123/179.3, 179.25, 179.28
See application file for complete search history.

(56) References Cited

U.S. PATENT DOCUMENTS

2008/0283012 A1 11/2008 Wanner

FOREIGN PATENT DOCUMENTS

| | | |
|---|---|---|
| DE | 39 22 492 | 1/1991 |
| DE | 10 2005 006 248 | 8/2006 |
| EP | 0 459 102 | 12/1991 |
| GB | 451 212 | 7/1936 |

*Primary Examiner* — Hai Huynh
(74) *Attorney, Agent, or Firm* — Kenyon & Kenyon LLP

(57) ABSTRACT

A parallel starter system for starting an internal combustion engine has at least two parallel-connected starters and a thermal switch associated with each of the starters, which thermal switch interrupts operation of the respective starter in the event of a response. The thermal switches are connected in series so that in the event of tripping of one of these thermal switches, the operation of all starters is interrupted.

6 Claims, 1 Drawing Sheet

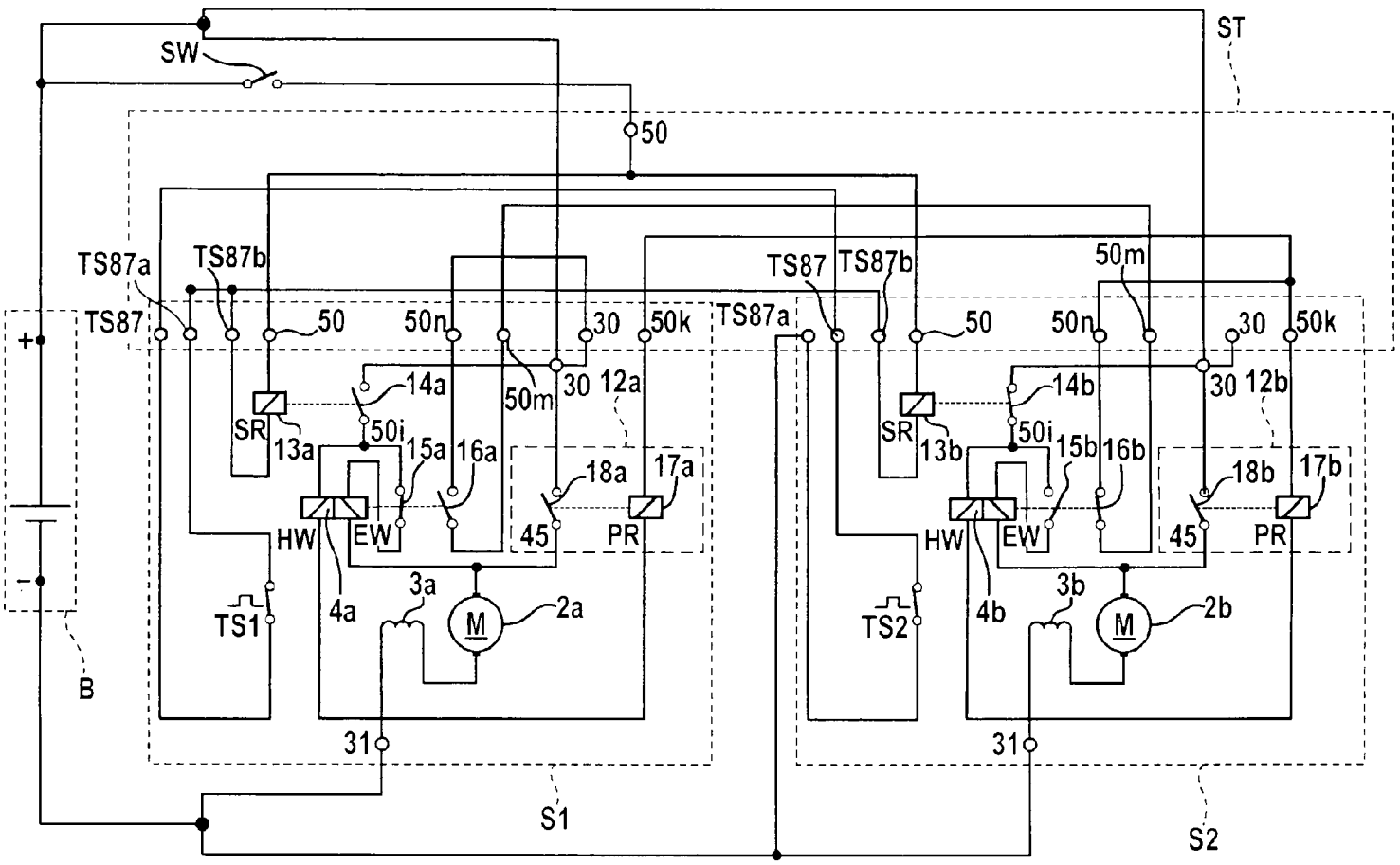
ST
50
SW
TS87a
TS87
TS87b
50k
30
50m
50n
50i
14a
12a
13a
SR
15a
16a
17a
18a
PR
45
EW
HW
4a
3a
2a
M
31
S1
TS1
B
+
-
TS87
TS87a
TS87b
50
13b
14b
12b
15b
16b
17b
18b
4b
3b
2b
S2
TS2

PARALLEL STARTER SYSTEM

BACKGROUND OF THE INVENTION

1. Field of the Invention

The invention relates to a parallel starter system for starting an internal combustion engine having at least two starters connected in parallel. Such parallel starter systems are used with engines having a larger displacement, in order to be able to supply the required high starter power.

2. Description of Related Art

Published German patent application document DE 39 22 492 A1 describes a starter protection circuit for starting an internal combustion engine of a motor vehicle. A thermal switch, which operates a starter operation-interrupting relay in the event of a response, is assigned to the starter. After resuming the cold-switching state of the thermal switch, renewed starter operation may be achieved via a relay operation button.

Published German patent application document DE 10 2005 006 248 A1 describes a parallel starter system having a low wiring complexity. It includes multiple starters connected in parallel, each having a starter motor and an engagement relay. This parallel starter system may be implemented in a particularly simple and inexpensive manner if at least one of the switches includes a power relay, which switches the main current path to the respective starter motor, and the engagement relay, the power relay and the starter motor are implemented as a structural unit.

BRIEF SUMMARY OF THE INVENTION

A parallel starter system of the present invention has the advantage over the related art that terminal 50 (shown in FIG. 1) of both or all starters of the parallel starter system is reliably isolated in the event the thermal switch of one of the starters is tripped. This increases the reliability of a parallel starter system in the event of a thermal overload of one of the starters.

The design and internal wiring of the connecting line ensures that both or all starters may have the same design. The wiring is determined only via the wiring in the connecting line. Each starter receives a plug contact having 8 pins.

BRIEF DESCRIPTION OF THE DRAWING

FIG. 1 shows a wiring diagram of a parallel starter system according to one exemplary embodiment of the present invention.

DETAILED DESCRIPTION OF THE INVENTION

FIG. 1 shows a parallel starter system having two starters S1 and S2 connected in parallel. Starter S1 includes a starter relay 13*a*, an engagement relay 4*a* having a hold-in winding HW and a pull-in winding EW, a power relay 17*a*, a starter motor 2*a*, a winding 3*a*, a thermal switch TS1 and switches 14*a*, 15*a*, 16*a* and 18*a*. Starter S2 includes a starter relay 13*b*, an engagement relay 4*b* having a hold-in winding HW and a pull-in winding EW, a power relay 17*b*, a starter motor 2*b*, a winding 3*b*, a thermal switch TS2 and switches 14*b*, 15*b*, 16*b* and 18*b*.

The main current of starter motor 2*a* of first starter S1 is switched by power relay 17*a*. The main current of starter motor 2*b* of second starter S2 is switched by power relay 17*b*. Engagement relay 4*a* serves to engage a pinion (not shown) into the appropriate gear rim of starter S1 and to provide the current for turning over starter S1. Engagement relay 4*b* engages a pinion (not shown) in the appropriate gear rim of starter S2 and provides the current for turning over starter S2.

In addition, the parallel starter system shown in FIG. 1 contains a system cable implemented in the form of a plug ST within which the connecting lines run between two starters S1 and S2. Each of the starters has a plug contact, each having 8 pins via which the respective starter S1 and S2 is connected to the plug, i.e., the system cable. The aforementioned 8 pins are labeled as TS87, TS87a, TS87b, 50, 50n, 50m, 30 and 50k.

Plug ST has a terminal in its upper area corresponding to terminal 50. This is connected by a switch SW to positive pole+of a battery B. In addition, a line leads from the positive pole of battery B through plug ST to terminal 30 of first starter S1. A line also leads from the positive pole of battery B through plug ST to terminal 30 of second starter S1. A connecting line leads from terminal 50 in the upper area of plug ST to pin 50 of starter S1. Another connecting line leads from terminal 50 in the upper area of plug ST to pin 50 of starter S2.

The negative pole of battery B is connected to pin 31 of first starter S1, to pin 31 of second starter S2, and to thermal switch TS2 of starter S2 via pin TS87 of starter S2.

Pin 31 of first starter S1 is connected to starter motor 2*a* of first starter S1 via winding 3*a*. Pin 31 of second starter S2 is connected to starter motor 2*b* of second starter S2 via winding 3*b*.

Thermal switches TS1 of first starter S1 and TS2 of second starter S2 are connected in series. Terminal 50 in the upper area of plug ST is thus connected to thermal switch TS2 of second starter S2 via pin 50 of first starter S1, starter relay 13*a* of first starter S1, pin TS87*b* of first starter S1, pin TS87*a* of first starter S1, thermal switch TS1 of first starter S1, pin TS87 of first starter S1, and pin TS87 of second starter S2. The other terminal of thermal switch TS2 is connected to the negative pole—of battery B via pin TS87*a* of second starter S2.

In a starting operation, initiated by closing of switch SW, starter relays 13*a* and 13*b*, which are connected in parallel, start at the same time and close corresponding switches 14*a* and 14*b*. Therefore, within the particular starter, the connection between pin 30 and point 50*i* is closed, and the control terminals of engagement relays 4*a* and 4*b* receive power.

The pinion of starters S1 and S2 is moved forward into the gear rim by both engagement relays 4*a* and 4*b* being pulled in. A limited current then flows into starters S1 and S2 via the pull-in winding of engagement relays 4*a* and 4*b*, thus causing the pinion to turn slightly. This slight turning simplifies the engagement procedure because tooth-on-tooth positions of the pinion on the gear rim may be eliminated in this way.

Switch 16*a* of engagement relay 4*a* and switch 16*b* of engagement relay 4*b* are able to close only when both pinions have been engaged. After both switches have closed, power relays 17*a* and 17*b* receive power, and therefore switch 18*a* of relay 17*a* and switch 18*b* of relay 17*b* are closed. After both switches are closed, starters S1 and S2 receive power directly and are able to start the engine.

The advantage of this circuit is that starting is possible only when both pinions have been engaged. This ensures that a uniform load on the starters is achieved.

If there is a thermal overload on one of the starters, then the particular thermal switch is tripped and interrupts operation of the particular starter. Since the two thermal switches are connected in series, tripping of one of the thermal switches also results in the current flow through the other thermal switch being interrupted. Therefore, operation of both starters is interrupted because they are no longer triggered via pin 50. This has the advantage that in the event of a thermal overload on one of the starters, operation of not only the overloaded starter but also the other starter of the parallel starter system is interrupted, thus preventing a thermal overload of the additional starter(s) of the parallel starter systems.

In contrast, in known parallel starter systems, the starter relay of the particular starter is interrupted by the tripping of a thermal switch, resulting in a drop in both power relays. However, this causes only a drop in the engagement relay of the particular starter. The second engagement relay remains pulled in, which may result in a thermal overload on the relay and additional subsequent damages. These disadvantages do not occur with a parallel starter system according to the present invention.

What is claimed is:

1. A parallel starter system for starting an internal combustion engine, comprising:

at least a first starter and a second starter connected to each other in parallel;

at least a first thermal switch and a second thermal switch assigned to the first starter and the second starter, respectively, wherein each thermal switch is configured to interrupt operation of the respective assigned starter in the event of a response, and wherein the thermal switches are connected in series to interrupt operation of the first and second starters in the event of tripping of one of the first and second thermal switches.

2. The parallel starter system as recited in claim 1, further comprising:

a battery having a positive pole connected by a battery switch and a starter relay of the first starter to the thermal switch of the first starter.

3. The parallel starter system as recited in claim 2, wherein the thermal switch of the first starter is connected to the thermal switch of the second starter by an output of the first starter and an input of the second starter.

4. The parallel starter system as recited in claim 3, wherein the thermal switch of the second starter is connected to the negative pole of the battery by an output of the second starter.

5. The parallel starter system as recited in claim 3, wherein the first and second starters are interconnected by a plug.

6. The parallel starter system as recited in claim 5, wherein each of the first and second starters has a plug contact having eight pins for connection to the plug (ST).

* * * * *

UNITED STATES PATENT AND TRADEMARK OFFICE

CERTIFICATE OF CORRECTION

PATENT NO. : 8,479,698 B2
APPLICATION NO. : 12/735246
DATED : July 9, 2013
INVENTOR(S) : Wanner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 540 days.

Signed and Sealed this
Eighth Day of September, 2015

Michelle K. Lee

Michelle K. Lee
*Director of the United States Patent and Trademark Office*